US007748406B2

(12) United States Patent
Pilatowicz et al.

(10) Patent No.: US 7,748,406 B2
(45) Date of Patent: Jul. 6, 2010

(54) TWO HANDLE PULL-OUT FAUCET

(75) Inventors: Edward Pilatowicz, Yorba Linda, CA (US); Oscar Romero, Lake Forest, CA (US); Alston E. Williams, Irvine, CA (US)

(73) Assignee: Newfrey LLC, Newark, DE (US)

( * ) Notice: Subject to any disclaimer, the term of this patent is extended or adjusted under 35 U.S.C. 154(b) by 632 days.

(21) Appl. No.: 11/524,122

(22) Filed: Sep. 20, 2006

(65) Prior Publication Data

US 2008/0223454 A1 Sep. 18, 2008

(30) Foreign Application Priority Data

Apr. 1, 2005 (WO) ..... PCT/US2005/011027

(51) Int. Cl.
*E03B 1/00* (2006.01)
*E03C 1/086* (2006.01)

(52) U.S. Cl. ..... 137/603; 239/449; 239/443; 4/678

(58) Field of Classification Search ..... 137/602, 137/603; 239/436, 443, 444, 445, 446, 447, 239/448, 449; 4/675, 677, 678
See application file for complete search history.

(56) References Cited

U.S. PATENT DOCUMENTS

| | | | |
|---|---|---|---|
| D40,106 | S | 6/1909 | Yacoobian |
| D76,995 | S | 11/1928 | Fraser |
| D83,923 | S | 4/1931 | Sakier |
| D87,829 | S | 9/1932 | Ferguson |
| D87,830 | S | 9/1932 | Ferguson |
| D186,012 | S | 8/1959 | Sosnick |
| D266,348 | S | 9/1982 | Piesco |
| D277,537 | S | 2/1985 | Merl et al. |
| D287,395 | S | 12/1986 | Piesco |
| D287,747 | S | 1/1987 | Miller et al. |
| D295,550 | S | 5/1988 | Yost |
| D295,551 | S | 5/1988 | Yost |
| D297,758 | S | 9/1988 | Paul |
| D299,852 | S | 2/1989 | Paul |
| D299,853 | S | 2/1989 | Paul |
| D299,854 | S | 2/1989 | Paul |
| D301,919 | S | 6/1989 | Paul |
| D302,202 | S | 7/1989 | Paul |
| D302,582 | S | 8/1989 | Paul |
| D302,849 | S | 8/1989 | Kohler, Jr. et al. |
| D312,681 | S | 12/1990 | Kohler, Jr. et al. |
| D316,747 | S | 5/1991 | Fleischmann |
| D318,099 | S | 7/1991 | Reid et al. |
| D318,714 | S | 7/1991 | Spangler |
| D318,717 | S | 7/1991 | Spangler |
| D318,906 | S | 8/1991 | Spangler |
| D320,434 | S | 10/1991 | Rawald |
| D321,039 | S | 10/1991 | Robbins |
| D325,426 | S | 4/1992 | Paul |

(Continued)

*Primary Examiner*—John K Fristoe, Jr.
(74) *Attorney, Agent, or Firm*—Richard J. Veltman; John D. DelPonti

(57) ABSTRACT

A dual-handle control faucet that includes a pull-out head and a faucet base. The pull-out head is switchable between a first water discharge pattern and a second water discharge pattern. The pull-out head switches from the first water discharge pattern to the second water discharge pattern upon disengagement with the faucet base, which provides for hands-free switching between to two spray patterns.

16 Claims, 9 Drawing Sheets

U.S. PATENT DOCUMENTS

| | | | | |
|---|---|---|---|---|
| D325,427 | S | 4/1992 | Paul | |
| D325,772 | S | 4/1992 | Carr | |
| D325,773 | S | 4/1992 | Paul | |
| D326,504 | S | 5/1992 | Robbins | |
| D327,531 | S | 6/1992 | Ko | |
| D327,532 | S | 6/1992 | Ko | |
| D332,135 | S | 12/1992 | Bonnell | |
| D334,230 | S | 3/1993 | Bonnell | |
| D340,968 | S | 11/1993 | McKeone et al. | |
| D347,268 | S | 5/1994 | Paul | |
| D348,307 | S | 6/1994 | Gottwald | |
| D349,155 | S | 7/1994 | McKeone et al. | |
| D350,390 | S | 9/1994 | Bollenbacher | |
| 5,348,231 | A * | 9/1994 | Arnold et al. | 239/428.5 |
| D352,767 | S | 11/1994 | McKeone | |
| D353,653 | S | 12/1994 | McKeone | |
| D356,631 | S | 3/1995 | Kolada | |
| D357,305 | S | 4/1995 | Fabian | |
| D357,525 | S | 4/1995 | Fabian | |
| D357,730 | S | 4/1995 | Saperstein | |
| D363,536 | S | 10/1995 | Hill et al. | |
| D364,219 | S | 11/1995 | Hill et al. | |
| D364,220 | S | 11/1995 | Hill et al. | |
| D365,384 | S | 12/1995 | Robbins | |
| D366,099 | S | 1/1996 | Hill et al. | |
| D367,920 | S | 3/1996 | Hill et al. | |
| D368,767 | S | 4/1996 | Gottwald | |
| D371,826 | S | 7/1996 | Robbins | |
| D372,299 | S | 7/1996 | Fabian | |
| D372,300 | S | 7/1996 | Fabian | |
| D372,764 | S | 8/1996 | Dubin | |
| D377,517 | S | 1/1997 | Doughty et al. | |
| D378,231 | S | 2/1997 | Dubin | |
| D379,849 | S | 6/1997 | Hill et al. | |
| D383,831 | S | 9/1997 | Esche et al. | |
| D385,955 | S | 11/1997 | Hundley et al. | |
| D388,864 | S | 1/1998 | Fabian | |
| D393,054 | S | 3/1998 | Doughty et al. | |
| D394,492 | S | 5/1998 | Nguyen et al. | |
| D398,963 | S | 9/1998 | Donahue et al. | |
| D402,005 | S | 12/1998 | Ko | |
| D404,470 | S | 1/1999 | Pitsch et al. | |
| D404,802 | S | 1/1999 | Delker | |
| D405,163 | S | 2/1999 | Doughty et al. | |
| D405,508 | S | 2/1999 | Doughty et al. | |
| D405,509 | S | 2/1999 | Doughty et al. | |
| D406,321 | S | 3/1999 | Hundley et al. | |
| D407,143 | S | 3/1999 | Hyde et al. | |
| D407,466 | S | 3/1999 | Hundley et al. | |
| D408,897 | S | 4/1999 | Warshawsky | |
| D409,292 | S | 5/1999 | Hyde et al. | |
| D414,845 | S | 10/1999 | Hyde | |
| D415,259 | S | 10/1999 | Slothower | |
| D417,262 | S | 11/1999 | Caplow | |
| D417,490 | S | 12/1999 | Formgren | |
| D418,204 | S | 12/1999 | Garcia | |
| D418,205 | S | 12/1999 | Hyde et al. | |
| D419,647 | S | 1/2000 | Warshawsky | |
| D421,642 | S | 3/2000 | Ko | |
| D421,789 | S | 3/2000 | Delker et al. | |
| D423,649 | S | 4/2000 | Lobermeier | |
| D425,968 | S | 5/2000 | Lobermeier | |
| D426,621 | S | 6/2000 | Biller et al. | |
| D426,872 | S | 6/2000 | Milrud et al. | |
| D426,873 | S | 6/2000 | Milrud et al. | |
| D428,118 | S | 7/2000 | McKeone | |
| D428,474 | S | 7/2000 | Milrud et al. | |
| 6,085,790 | A * | 7/2000 | Humpert et al. | 137/801 |
| D429,316 | S | 8/2000 | McKeone | |
| D429,318 | S | 8/2000 | Spangler | |
| D429,522 | S | 8/2000 | Spangler | |
| D429,523 | S | 8/2000 | Spangler | |
| D429,798 | S | 8/2000 | Milrud et al. | |
| D429,799 | S | 8/2000 | Spangler | |
| D429,800 | S | 8/2000 | Spangler | |
| D430,924 | S | 9/2000 | Wei et al. | |
| D433,103 | S | 10/2000 | Spangler | |
| D433,733 | S | 11/2000 | Lord | |
| D433,735 | S | 11/2000 | Lord | |
| D434,118 | S | 11/2000 | Lord | |
| D434,119 | S | 11/2000 | Milrud et al. | |
| D438,601 | S | 3/2001 | Caplow | |
| D438,602 | S | 3/2001 | Milrud et al. | |
| D439,954 | S | 4/2001 | Spangler | |
| D440,633 | S | 4/2001 | Fleischmann | |
| D441,058 | S | 4/2001 | Fleischmann | |
| D441,432 | S | 5/2001 | Fleischmann | |
| D441,433 | S | 5/2001 | Spangler | |
| D441,434 | S | 5/2001 | Dretzka | |
| D441,844 | S | 5/2001 | Fleischmann | |
| D442,676 | S | 5/2001 | Dretzka | |
| D443,678 | S | 6/2001 | Lord | |
| D443,920 | S | 6/2001 | Lord | |
| D444,543 | S | 7/2001 | Fleischmann | |
| D444,544 | S | 7/2001 | Lord | |
| D444,859 | S | 7/2001 | Slothower | |
| D444,860 | S | 7/2001 | Slothower | |
| D446,287 | S | 8/2001 | Fleischmann | |
| D447,542 | S | 9/2001 | Dretzka | |
| D448,067 | S | 9/2001 | Pitsch | |
| D448,456 | S | 9/2001 | Lord | |
| D455,196 | S | 4/2002 | Caplow | |
| D456,063 | S | 4/2002 | McKeone | |
| 6,370,713 | B2 * | 4/2002 | Bosio | 4/677 |
| D456,879 | S | 5/2002 | Doughty et al. | |
| D458,344 | S | 6/2002 | M¨ullenmeister | |
| D458,346 | S | 6/2002 | M¨ullenmeister | |
| D458,347 | S | 6/2002 | M¨ullenmeister | |
| D458,349 | S | 6/2002 | M¨ullenmeister | |
| D458,667 | S | 6/2002 | Gottwald | |
| D458,989 | S | 6/2002 | M¨ullenmeister | |
| D459,791 | S | 7/2002 | Yegyayan | |
| D459,792 | S | 7/2002 | Lai | |
| D460,158 | S | 7/2002 | Green et al. | |
| D460,529 | S | 7/2002 | Caplow | |
| D460,531 | S | 7/2002 | Ko | |
| D460,533 | S | 7/2002 | Singtoroj | |
| D460,534 | S | 7/2002 | Hanna et al. | |
| D460,806 | S | 7/2002 | Singtoroj | |
| D460,807 | S | 7/2002 | Singtoroj | |
| D460,808 | S | 7/2002 | Otero et al. | |
| D461,229 | S | 8/2002 | Hanna | |
| D461,536 | S | 8/2002 | Singtoroj | |
| D461,541 | S | 8/2002 | Singtoroj | |
| D461,543 | S | 8/2002 | M¨ullenmeister | |
| D461,879 | S | 8/2002 | M¨ullenmeister | |
| D462,418 | S | 9/2002 | Smith | |
| D462,421 | S | 9/2002 | Hundley | |
| D462,749 | S | 9/2002 | Lord | |
| D463,012 | S | 9/2002 | Otero et al. | |
| D463,013 | S | 9/2002 | Green et al. | |
| D464,404 | S | 10/2002 | Lord | |
| D464,405 | S | 10/2002 | Lord | |
| D464,408 | S | 10/2002 | Gottwald | |
| D464,714 | S | 10/2002 | Lord | |
| D465,010 | S | 10/2002 | Lord | |
| D466,985 | S | 10/2002 | McKeone | |
| D465,268 | S | 11/2002 | M¨ullenmeister | |
| D465,270 | S | 11/2002 | Gottwald | |
| D465,832 | S | 11/2002 | Singtoroj | |
| D465,834 | S | 11/2002 | Singtoroj | |
| D466,196 | S | 11/2002 | Otero et al. | |
| D466,197 | S | 11/2002 | Singtoroj | |
| D467,316 | S | 12/2002 | Otero et al. | |

D467,317 S 12/2002 Otero et al.
D467,318 S 12/2002 Otero et al.
D467,319 S 12/2002 Otero et al.
D467,320 S 12/2002 Yegyayan
D468,406 S 1/2003 Sacks et al.
D469,856 S 2/2003 Bouilloux et al.
D470,573 S 2/2003 Marshall
D470,574 S 2/2003 Marshall
D470,575 S 2/2003 Marshall
D470,576 S 2/2003 Marshall
D470,922 S 2/2003 Marshall
D470,923 S 2/2003 Marshall
D470,925 S 2/2003 Blomstrom
D471,964 S 3/2003 Bates et al.
D473,932 S 4/2003 Caplow
D473,933 S 4/2003 Warshawsky et al.
D474,671 S 5/2003 Singtoroj et al.
D474,834 S 5/2003 Czerwinski, Jr. et al.
D474,957 S 5/2003 Singtoroj et al.
D475,438 S 6/2003 Tolosa
D475,766 S 6/2003 Tolosa
D475,767 S 6/2003 Yegyayan et al.
D477,057 S 7/2003 Schönherr et al.
D477,386 S 7/2003 Schönherr et al.
D477,860 S 7/2003 Singtoroj
D478,157 S 8/2003 Yegyayan
D478,375 S 8/2003 Hundley
D478,966 S 8/2003 Citterio
D479,311 S 9/2003 Veltz
6,619,567 B1 * 9/2003 Ouyoung ..... 239/441
D482,758 S 11/2003 Bates et al.
D482,759 S 11/2003 Otero
D482,760 S 11/2003 Fraser et al.
D483,093 S 12/2003 Bates et al.
D484,573 S 12/2003 Haug et al.
D484,950 S 1/2004 Blattner
D484,951 S 1/2004 Lin
D484,952 S 1/2004 Marshall
D486,563 S 2/2004 Hsieh
D487,132 S 2/2004 Zhao
D487,305 S 3/2004 Ouyoung
D487,499 S 3/2004 Zhao
D487,799 S 3/2004 Czerwinski, Jr. et al.
D487,916 S 3/2004 Lord
D487,917 S 3/2004 Lord
D487,923 S 3/2004 Fraser et al.
D487,924 S 3/2004 Lin
D487,925 S 3/2004 Lin
D488,539 S 4/2004 McKeone
D488,540 S 4/2004 Ouyoung
D488,541 S 4/2004 Lin
D488,542 S 4/2004 Spiegelberg et al.
D489,120 S 4/2004 Shieh
D489,432 S 5/2004 Lammel et al.
D490,501 S 5/2004 Ouyoung
D490,502 S 5/2004 Ouyoung
D490,503 S 5/2004 Fraser et al.
D490,504 S 5/2004 Lin
D490,879 S 6/2004 Lin
D490,881 S 6/2004 Lin
D491,633 S 6/2004 Ouyoung
D491,637 S 6/2004 Lin
D491,638 S 6/2004 Lin
D491,639 S 6/2004 Egee
D491,640 S 6/2004 Lin
D491,641 S 6/2004 Lin
D491,642 S 6/2004 Lin
D492,009 S 6/2004 Egee
D492,013 S 6/2004 Citterio
D492,387 S 6/2004 Pohl et al.
D492,981 S 7/2004 Bloomstrom
D493,213 S 7/2004 Svendsen et al.
D495,402 S 8/2004 Spiegelberg et al.
D496,717 S 9/2004 Svendsen et al.
D497,198 S 10/2004 Painter et al.
7,070,125 B2 * 7/2006 Williams et al. ..... 239/443
7,380,731 B1 * 6/2008 Hsu ..... 239/447

* cited by examiner

TWO HANDLE PULL-OUT FAUCET

FIELD OF THE INVENTION

The present invention relates to a pull-out sink faucet, and more particularly, to a pull-out sink faucet with independent hot and cold water control and a pull-out head that changes between a spray mode and a stream mode when attached or detached from the faucet.

BACKGROUND OF THE INVENTION

Faucets are often provided with a pull-out head. The pull-out head allows the user to point water flow from the pull-out head to destinations where the flow is useful and where conventional faucets may not reach. For example, when washing pots and pans, the user may pull out the head and direct the flow into the pots and pans rather than moving about the pots or pans under the faucet. Thus, the pull-out head is typically much lighter and much easier to negotiate then the item that is being washed.

Faucets with pull-out heads have offered varied output patterns. To that end, output patterns have included a stream pattern, which is typically from an aerator or a spray pattern, which is typically from a spray ring or an arrangement of nozzles. A switch or the like, which requires manual actuation by the user, is typically employed to switch between the output patterns available. In addition, flow control is typically adjusted by a singular mixing valve rather than independent hot and cold water control valves. As such, pull-out head faucets may require the user to manually switch between spray modes and use a single mixing valve to regulate water flow and temperature.

Accordingly, it is desirable to provide an improved pull-out head faucet that switches between the output spray patterns without requiring the use of a manual switch and further provide independent hot and cold water control to the faucet.

SUMMARY OF THE INVENTION

A dual-handle control faucet is constructed in accordance with the present invention and includes a pull-out head and a faucet base. The pull-out head is operable between a first water discharge pattern and a second water discharge pattern. The pull-out head switches from the first water discharge pattern to the second water discharge pattern upon disengagement with the faucet base, which provides for hands-free switching between two spray patterns.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the appended claims, the detailed description, and the accompanying drawings of the exemplary embodiments wherein:

DETAILED DESCRIPTION OF THE PREFERRED EMBODIMENTS

The following description of the preferred embodiments is merely exemplary in nature and is in no way intended to limit the invention, its application, or uses.

Figure 1:
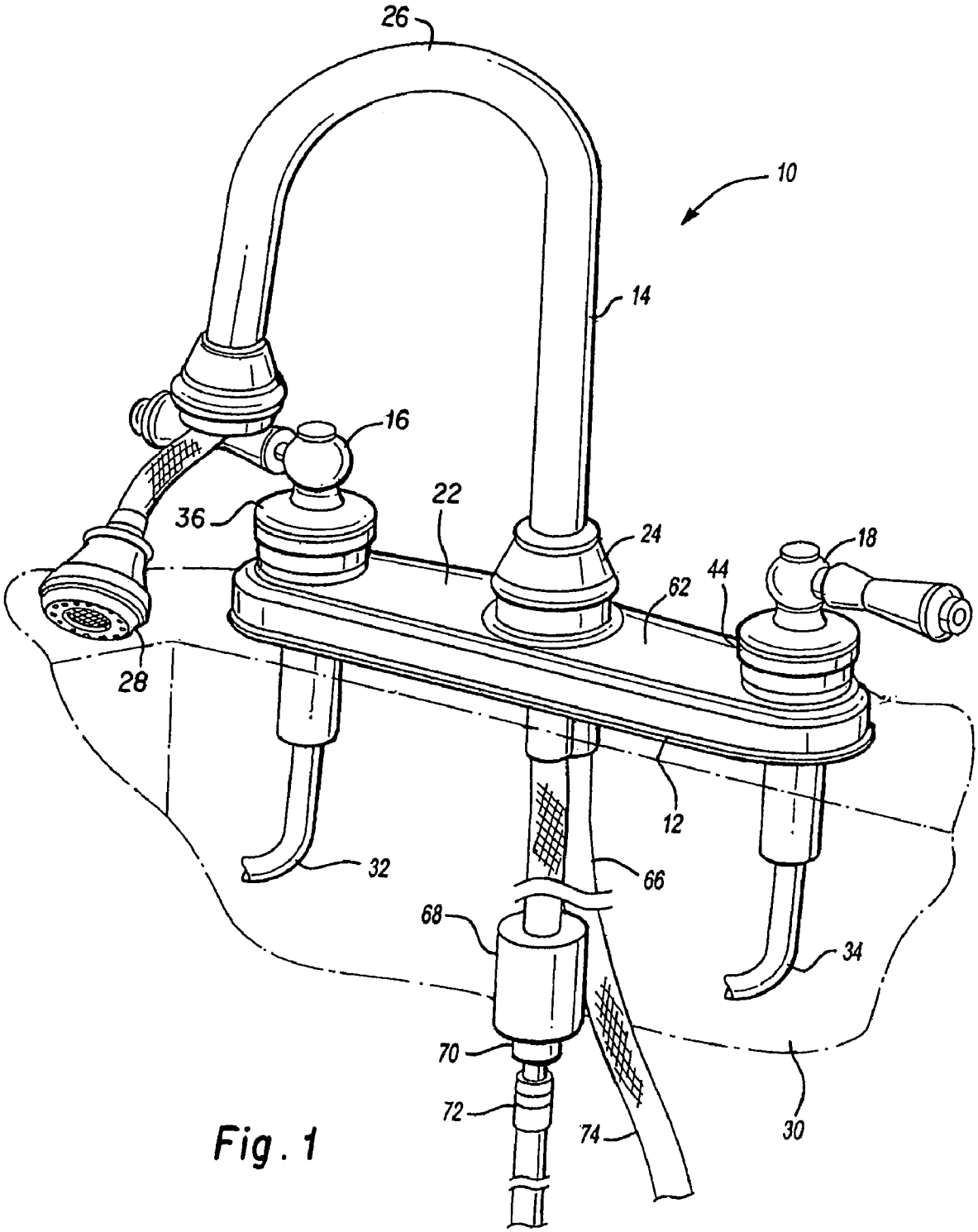
FIG. 1 is an environmental view of a pull-out faucet having a pull-out head and independent hot and cold water controls constructed in accordance with the principles of the present invention.
Figure 2:
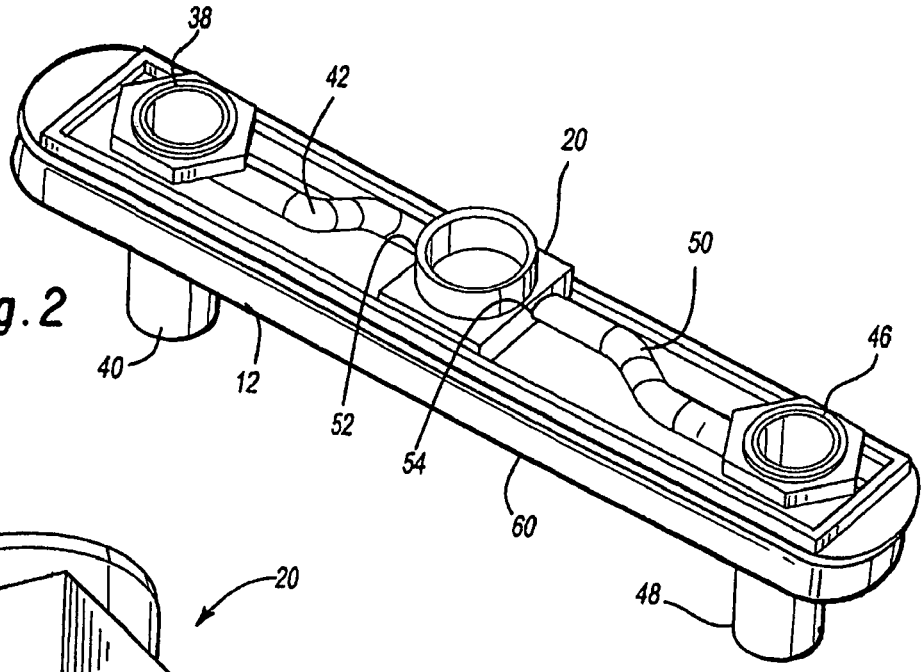
FIG. 2 is a perspective top view of a faucet base plate of the pull-out faucet of FIG. 1.
Figure 3:
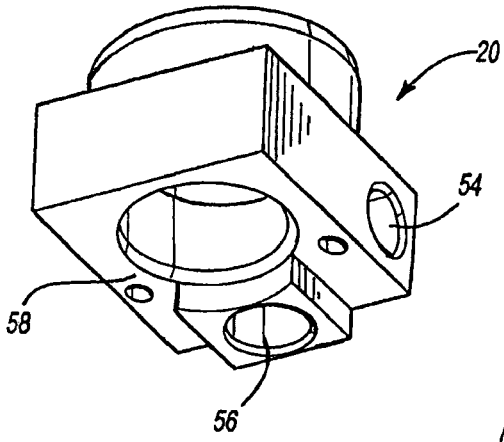
FIG. 3 is a perspective view of a central body of the pull-out faucet of FIG. 1.
Figure 5:
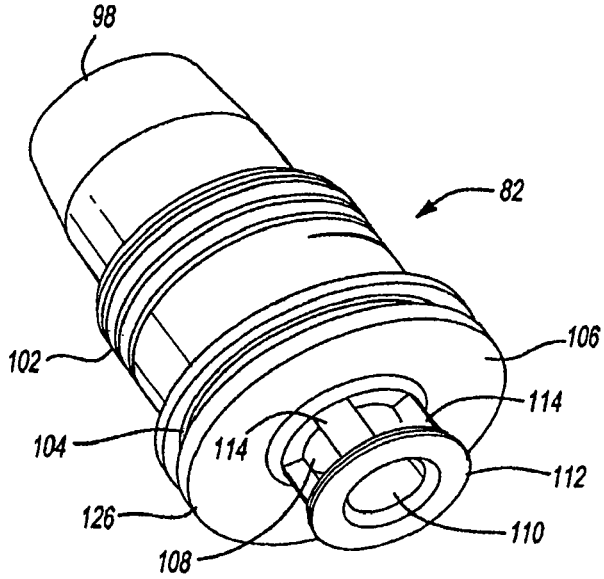
FIG. 5 is a perspective view of a flow toggle of FIG. 4.

With reference to FIGS. 1, 2 and 3, a pull-out faucet of the preferred embodiment of the present invention is generally indicated by reference numeral 10. The pull-out faucet 10 includes a faucet base 12 to which a spout 14 is connected. The faucet base 12 includes a hot water control 16, and a cold water control 18, both of which provide fluid regulation and are disposed on opposite ends of the faucet base 12. The faucet base 12 further includes a central body 20 into which the fluid flows from the hot and cold water control 16, 18. A faucet cowling 22 provides a decorative cover for the faucet base 12 and protects the faucet base 12 from the environment in which it was installed. The spout 14 is composed of a swivel base 24 and a neck 26. A pull-out head 28 is configured to be removably mounted to the spout 14. The pull-out faucet 10 is conventionally mounted to a sink 30 (shown in shadow) or any other suitable location. Conventional mounting of the pull-out faucet 10 further includes connection to a conventional hot water supply line 32 and a conventional cold water supply line 34.

The hot water control 16 further includes a hot water regulator or valve 36 that is seated in a hot water control mounting body 38. A hot water supply line connection point 40 is connected to the hot water control mounting body 38. A hot water cupper pipe 42 connects the hot water control mounting body 38 to the central body 20. The cold water control 18 further includes a cold water regulator or valve 44 that is seated in a cold water control mounting body 46. A cold water supply line connection point 48 is connected to the cold water control mounting body 46. A cold water cupper pipe 50 connects the cold water control mounting body 46 to the central body 20.

The central body 20 includes a hot fluid input 52, a cold fluid input 54, and a mixed fluid output 56. The control body 20 also includes a hose pass-through 58. The control body 20 is connected to the faucet body 12. One skilled in the art will readily appreciate that the central body 20 may be located at various point in the faucet base 12 and be secured by various forms of connection.

In a conventional installation, as shown in FIG. 1, the pull-out faucet 10 is mounted on top of a deck 64 (shown in shadow) of the sink 30. Positioned in a central location on the faucet base plate 60 is the central body 20, from which the hot water cupper pipe 42 and the cold water cupper pipe 50 extend to the hot water control 16 and cold water control 18, respectively. The hot water cupper pipe 42 connects to the hot water regulator 36 contained within the hot water control mounting body 38. The hot water control mounting body 38 is also configured to accept a hot water supply line 32 at the hot water supply line connection point 40. As such, the hot water regulator 36 controls the flow of hot water into the central body 20, thereby controlling the amount of hot water emitted from the pull-out head 28. The cold water cupper pipe 50 connects to the cold water regulator 44 contained within the cold water control mounting body 46. The cold water control mounting body 46 is also configured to accept a cold water supply line 34 at the cold water supply line connection point 48. The cold water regulator 44, like hot water regulator 36, controls the flow of cold water to the pull-out head 28.

The faucet base 12 is mounted to the deck 64 of the sink 30. The hot water control mounting body 38 and the cold water control mounting body 46, however, pass through the deck 64 allowing hot and cold water supply lines 32, 34 to be connected to the hot and cold water supply line connection points 40, 48, respectively, beneath the deck 64. It should be appreciated by one skilled the art that decorative cowlings may be used to cover various components of the pull-out faucet 10. These cowlings may serve to protect the components covered by the cowling from the elements inherent in a sink installation or may serve the sole function of aesthetic appeal.

One skilled in the art will readily appreciate that mounting configurations of the pull-out faucet 10 may take many forms, such that, the faucet 10 may be mounted to a conventional sink, a wash tub, a bath tub, or any location requiring a regulated water supply. The various locations, therefore, may motivate many possible types of installations resulting in various components mounted above or beneath the deck of the sink or the like. Other types of installations may exclude the sink or the sink deck altogether.

The central body 20 is connected to the hot water cupper pipe 42 and the cold water cupper pipe 50 at the hot fluid input 52 and the cold fluid input 54, respectively. Variable amounts of hot and cold water mix within the central body 20 and flow out of the mixed fluid output 56. The mixed fluid output 56 is connected to a hose 66, which passes through the spout 14 and is ultimately connected to the pull-out head 28. One skilled in the art will readily appreciate that many faucet spout and faucet base configurations are possible; such that, the faucet base of the preferred embodiment can be connected to many different spout configurations, while the faucet spout of the preferred embodiment can connected to many different faucet base configurations.

The spout 14 includes the swivel base 24 and the neck 26, from which the pull-out head 28 is detached. The pull-out head 28 is attached to the hose 66 which includes a weight 68, threaded connectors 70 and quick-disconnect connectors 72. The hose 66 is connected to the mixed fluid output 56 of the central body 20 and then connected to the pull-out head 28. The hose 66 when connected to the mixed fluid output 56 is passed through the deck 64 of the sink 30, which may provide a loop of hose slack 74 to hanging beneath the deck 64. The weight 68 is coupled to the hose 66 along a general mid-point of the hose slack 74. The hose 66 may be further divided into sections and secured by the threaded connectors 70 or the quick-disconnect connectors 72. Use and placement of the weight 68, the threaded connectors 70, and quick-disconnect connectors 72 may be installation dependent, therefore, use, placement, or exclusion of the weight 68, threaded connectors 70, and the quick-disconnect connectors 72 do not serve to limit the invention or its operability.

The fluid flow path of the pull-out faucet 10 originates with the hot and cold water supplied by the hot and cold water supply lines 32, 34 that are connected to the hot water supply line connection point 40 and the cold water supply line connection point 48, respectively. Hot and cold water flow into the hot water control mounting body 38 and the cold water control mounting body 46, respectively. The hot water regulator 36 and the cold water regulator 44 regulate the amount of hot and cold water that flows into central body 20 through hot fluid input 52 and the cold fluid input 54 via the hot water cupper pipe 42 and the cold water cupper pipe 50 respectively. The now mixed hot and cold water exits the central body 20 through the mixed fluid output 56. The hose 66, connected to the mixed fluid output 56, carries the now mixed water beneath the deck 64 of the sink 30 and then back up through the deck 64 as the hose 66 passes through the hose pass-through 58 of the central body 20. The hose 66 continues to carry the mixed water though the spout 14 and connects with the pull-out head 28 at the end of the spout 14. The mixed water is ejected through the pull-out head 28 for use in the sink 30 or the like.

With reference to FIGS. 4, 5, 6*a*, 6*b*, and 7, pull-out head 28 includes a retainer ring 76 that passes through an outer housing 78 to connect to a hose connector 82. A spring 80 and a first sealing ring 84 are connected to the hose connector 82. A rubber gasket 86, a hold-down nut 88, and a rubber washer 90 are contained within an aerator assembly 92. A second sealing ring 94 is connected to an aerator housing 96 that connects with the outer housing 78.

The hose connector 82 further includes a hose connection point 98, which may connect with the hose 66 using a first threaded portion 100. A second threaded portion 102 connects with the retainer ring 76. A first sealing ring seat 104 is configured to accept the first sealing ring 84. A sealing face 106 defines a flow output orifice 108 that contains a flow deflector 110, a flow deflector lip 112, and standoffs 114. The aerator housing 96 further includes an aerator assembly seat 116, a spray ring 118, and a second sealing ring seat 120 configured to accept the second sealing ring 94.

Figure 4:
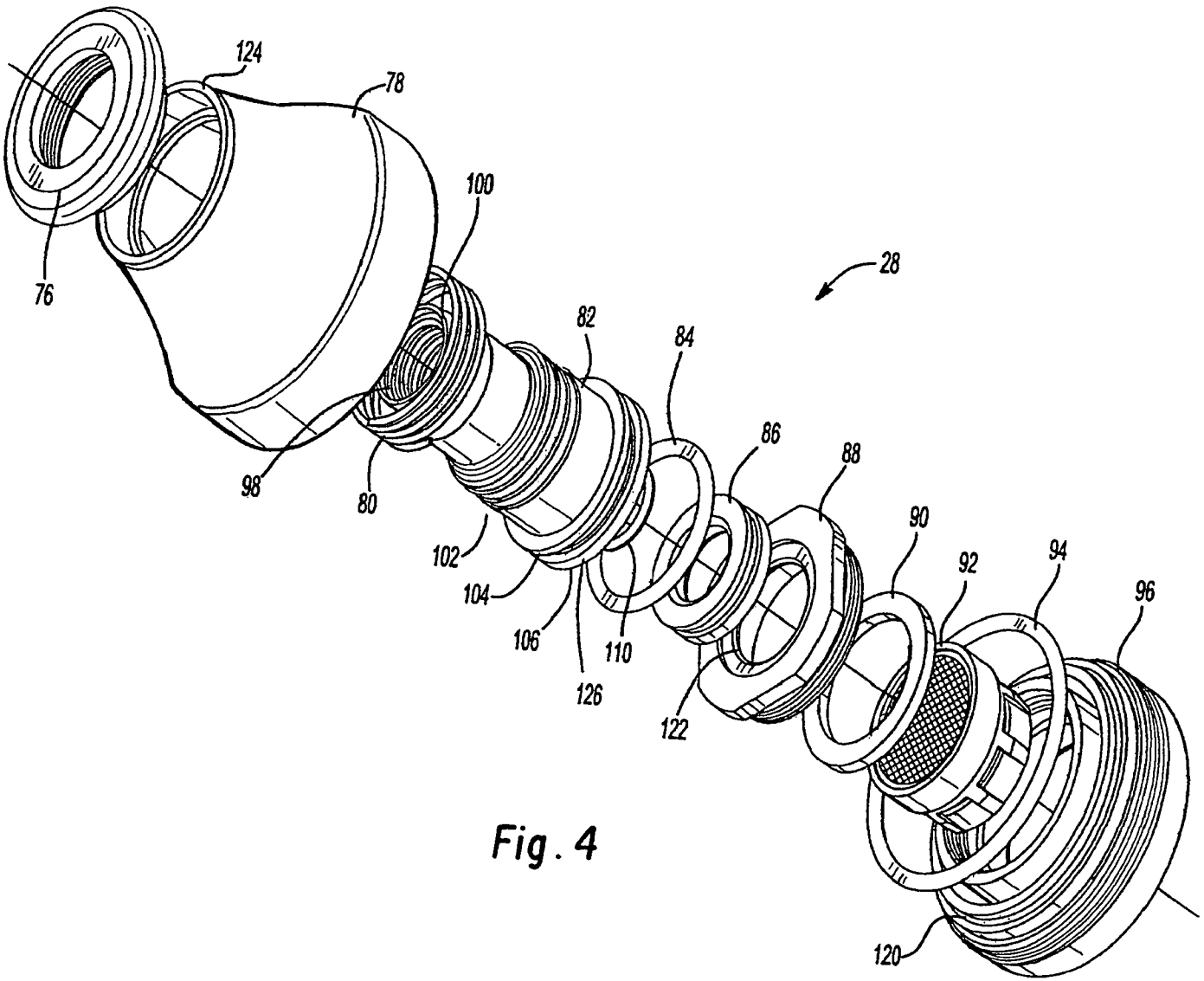
FIG. 4 is an exploded perspective view of the components of the pull-out head of the present invention.
Figure 6:
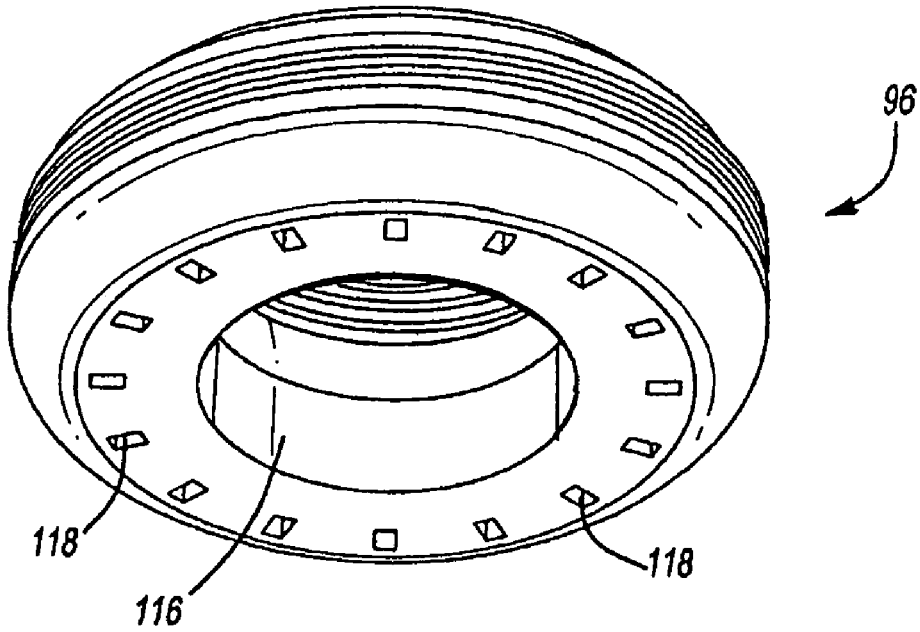
FIG. 6 is a perspective view of an aerator housing of FIG. 4.
Figure 7:
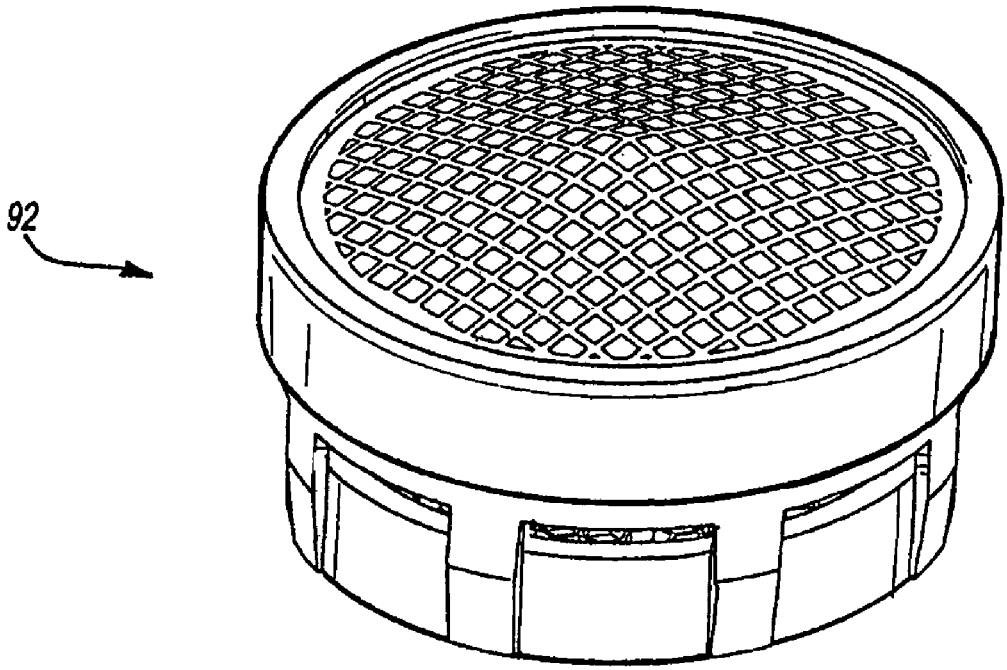
FIG. 7 is a perspective view of an aerator assembly of FIG. 4.
Figure 8:
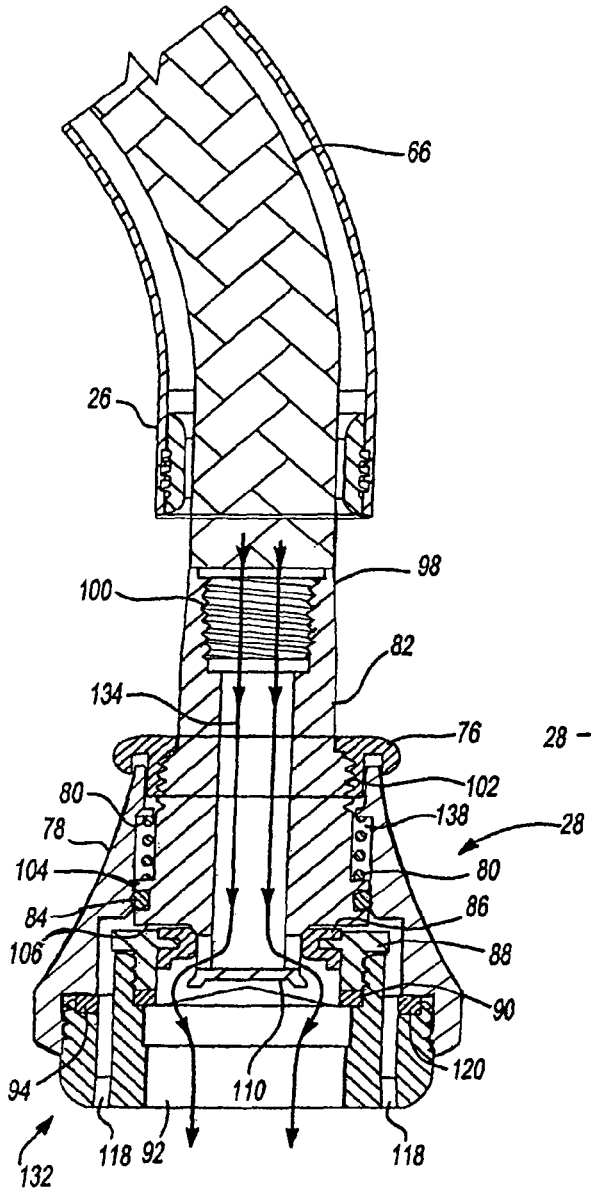
FIG. 8 is a cross-sectional view of the pull-out head in a stream mode constructed in accordance with the present invention.
Figure 9:
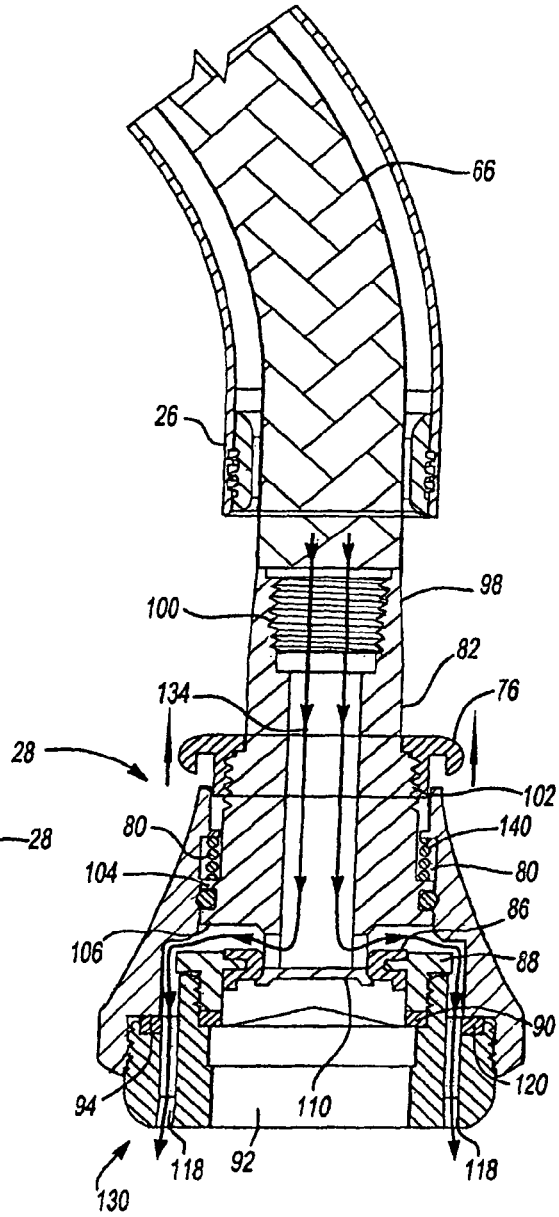
FIG. 9 is a cross-sectional view of the pull-out head in a spray mode.

With reference to FIGS. 4, 8, and 9, the pull-out head 28 is configured such that a portion of the hose connector 82 passes from inside the outer housing 78 and connects with the retainer ring 76, which sits generally atop the outer housing 78. The retainer ring 76 is connected to the hose connector 82 by rotating the retainer ring 76 onto the second threaded portion 102 and then both the retainer ring 76 and the hose connector 82 may move as one unit relative to the outer housing 78. One skilled in art will readily appreciate that many other methods exist to connect the retainer ring 76 and the hose connector 82, one such exemplary method is a snap-fit. Notwithstanding the manner by which the outer housing 78 is attached to the retainer ring 76, the pull-out head 28 is further configured so that the spring 80 is captured between an annular flange 124 of the outer housing 78 and the hose connector 82 when the retainer ring 76 is attached to the hose connector 82.

The first sealing ring seat 104 on the hose connector 82 is configured to accept the first sealing ring 84. The seated first sealing ring 84 positions and secures the hose connector 82 in the outer housing 78 and seals the interior of the outer housing 78 above the first sealing ring 84. Insertion of the hose connector 82 into the outer housing 78, therefore, causes the first sealing ring 84 to contact and seal against the interior of the outer housing 82. Furthermore, the first sealing ring 84 seals the hose connector 82 to the outer housing 78 so that the fluid within the pull-out faucet 10 is unable to travel beyond the first sealing ring 84 in the direction of the retaining ring 76.

The rubber gasket 86 is configured to sit within an inner ring 122 of the hold-down nut 88; thus, when seated the rubber gasket 86 and the hold-down nut 88 are essentially one assembly. When the hold-down nut 88 is rotated to secure the aerator assembly 92 in the aerator housing 96, the rubber gasket 86 may rotate with the hold-down nut 88. Nevertheless, the rubber gasket 86 remains operable in any angular orientation even though it rotates with the hold-down nut 88. When the hold-down nut 88 is rotated over the aerator assembly 92, the hold-down nut 88 secures the rubber washer 90 against the aerator assembly 92; thus, securing both the rubber washer 90 and the aerator assembly 92 within the aerator housing 96.

The hose connector 82 includes the sealing face 106 that defines the flow output orifice 108. The flow deflector 110 and the flow deflector lip 112 extend from the output orifice 108 by use of the standoffs 114. The sealing face 106 includes an annular arcuate portion 126 and within the annular arcuate portion 126 is the flow output orifice 108. The hose connector 82, thus, has an internal channel 128 that runs from the hose connector point 98 to the flow output orifice 108. Extending from the flow output orifice 108 is the flow deflector 110, which contains a flow deflector lip 112. The flow deflector 110 is disposed above the flow output orifice 108 by four standoffs 114.

With the hose connector 82 connected with the retaining ring 76 and the aerator assembly 92 secured within the aerator housing 96, the outer housing may be secured to the aerator housing 96 to ultimately assemble the pull-out head 28. The aerator housing 96 is configured to accept the second sealing ring 94, such that when the outer housing 78 is rotated to attach to the aerator housing 96 the second sealing ring 94 is compressed between the outer housing 78 and the aerator housing 96. Compression of the second sealing ring 94 prevents fluid from exiting the pull-out head 28 from the area where the outer housing 78 and the aerator housing 96 connect.

In FIG. 8, the pull-out head 28 is presented in stream mode, which is generally indicated by reference numeral 132. In FIG. 9, the pull-out head 28 is presented in a spray-mode, which is generally indicated by reference numeral 130. Switching between the spray-mode 130 and the stream-mode 132 is effectuated by movement of the hose connector 82, such that moving the hose connector 82 to the bottommost point of its travel results in the pull-out head 28 entering the stream-mode 132. In turn, moving the hose connector to the topmost point of its travel results in the pull-out head 28 entering the spray-mode 130.

In the spray-mode 130, the hose connector 82 is in the topmost point of its travel, such that the flow deflector lip 112 of the flow deflector 110 has moved up and sealed against the rubber gasket 86. Sealing of the flow deflector lip 112 against the rubber gasket 86 prevents the fluid from continuing past the rubber gasket 86, thereby forcing the fluid to flow over and past the outside of the hold-down nut 88. As indicated by flow-indicating arrow 134, the fluid continues into an annular channel 136 and then is finally emitted from a spray ring 118.

In the preferred embodiment of the present invention, the spray ring contains 16 rectangular openings 142 with the dimensions of about 0.04 inches by about 0.05 inches. The fluid exits the rectangular openings 142 in spray columns that are individually perceivable when compared to the column of flow from the aerator assembly 92. One skilled in the art will readily appreciate that the rectangular openings 142 may be sized in various dimensions. To that end, the rectangular openings 142 may be circular openings or any other suitable geometric shape. Furthermore, the dimensions may be sized in any suitable configuration as to produce streams from the spray ring 118.

In the stream-mode 132, the hose connector 82 is in the bottommost point of its travel, such that the sealing face 106 and the annular arcuate portion 126 seal against the rubber gasket 86. When sealed, the flow deflector 110 is disposed beneath the rubber gasket 86, such that the fluid is forced to flow out of the flow output orifice 108 and into the aerator assembly 92. To that end, the fluid is unable to flow beyond where the annular arcuate portion 126 has sealed against the rubber gasket 86, which prevents any fluid from flowing through to the spray ring 118. As such, fluid flowing from the pull-out head 28 in the stream mode 132 only flows though the aerator assembly 92 in a stream output.

In the preferred embodiment of the present invention, the aerator assembly 92 is commercially available from Neoperl, Inc. (Waterbury, Conn.) under the model name Perlator. The fluid exits the aerator assembly 92 in a large column and lacks the individually perceivable streams when compared to water exiting the spray ring 18 when the pull-out head 28 is in the spray mode 130. One skilled in the art will further appreciate that the ultimate pattern produced can be varied with modification of the aerator assembly 92 or the spray ring 118.

Switching between the spray mode 130 and the stream mode 132 may be effectuated by attachment or detachment of the pull-out head 28 to the end of the neck 26 of the spout 14. With the pull-out head 28 attached to the spout 14, the pull-out head 28 remains in the stream mode 132 because the end of the neck 26 has pushed the retaining ring 76 and thus the hose connector 82 down to the bottommost point of its travel.

In FIG. 8, the pull-out head 28 is shown in the stream mode 132 and, as such, the spring 80 is configured to be in a rest condition 138. In FIG. 9, the pull-out head is shown in the spray mode 130 and, as such, the spring 80 is configured to be in a compressed condition 140. It, therefore, follows that movement of the spring 80 from the rest position 138 (FIG. 8) to the compressed condition 140 (FIG. 9) generates a spring force in the spring 80; such that, the spring 80 imparts a predetermined force in an attempt to return to its rest position 138.

The pull-out head 28, however, is configured to remain in the spray mode 130 while water or a like fluid flows through the pull-out head 28. Fluid flow through the pull-out head 28 in the spray mode 130, therefore, imparts a sufficient pressure on the sealing face 106 to maintain the pull-out head 28 in the spray mode 130. As such, when the fluid flow is discontinued, the spring force imparted by the spring 80 in the compressed condition 140 is sufficient to restore the pull-out head 28 to the stream mode 132. It follows, therefore, that the spring force imparted by the spring 80 in the compressed condition 140 is less than the pressure exerted on the sealing face 106 of the hose connector 28 in the spray mode 130.

Typically when the pull-out head 28 is attached to the neck 26, the pull-out head remains in the stream mode 132. When a user (not shown) wishes to detach the pull-out head 28 from the neck 26, the user may grasp the outer housing 78 or the aerator housing 96 and draw the pull-out head 28 away from the neck 26 and manipulate the head accordingly. As the user draws the pull-out head 28 away from the neck 26, the hose 66, the weight 68, and the neck 26 are configured to slightly restrain the pull-out head 28 so that the action of drawing the pull-out head 28 out of the neck 26 causes the pull-out head 28 to change from the stream mode 132 to the spray mode 130.

As noted above, if fluid is flowing through the pull-out head 28, the head 28 will remain in the spray mode 130. If no fluid is flowing through the head, the pull-out head 28 will revert back to the stream mode 132 when the force generated by the action of drawing the pull-out head 28 out of the neck 26 no longer exists. Furthermore, the pull-out head 28 may drawn from the neck 26 while fluid flows through the pull-out head 28, but the user may subsequently discontinue fluid flow through the pull-out head 28 by, among other things, shutting off the faucet 10. When fluid flow is discontinued, the pull-out head 28 reverts back to the stream mode 132. Regardless of whether the pull-out head 28 is attached or detached to the neck 26 or whether fluid is flowing through the pull-out head 28, the user may manually push or pull on the retaining ring 76 to manually switch the pull-out head 28 between the spray mode 130 and the stream mode 132.

A user may also detach the pull-out head 28 from the neck 26 of the faucet 10 but grasp the retaining ring 76 instead of the outer housing 78 or aerator housing 96 of the pull-out head 28. In doing so, the pull-out head 28 is prevented from switching into the spray mode 130. The user may subsequently grasp the retainer ring 76 and pull to switch the pull-out head 28 from the stream mode 132 to the spray mode 130.

It should be appreciated by one skilled in the art that the retaining ring 76 may take many forms or may not be included with the pull-out faucet 10. For example, the retainer ring 76 may take the form of a knob or collar attached to the hose 66 or any such head control mechanism that assists the user in switching between the spray patterns of the pull-out head 28. As such, one skilled in the art should further appreciate that the spray mode 130 and the stream mode 132 or exemplary spray patterns and the pull-out head 28 may be configured with alternative spray pattern configurations.

FIGS. 10 through 14 depict the pull-out head 28 constructed in accordance with a preferred alternative embodiment of the present invention. As such, reference numerals that depict similar structures may be used to denote structures common to the various embodiments. It should be appreciated by one skilled in the art that structures disclosed in any one embodiment may be interchangeable with other embodiments. It should also be appreciated that the disclosed embodiments of the present invention are descriptive in nature and do not serve to limit the invention to the disclosed embodiments.

Figure 10:
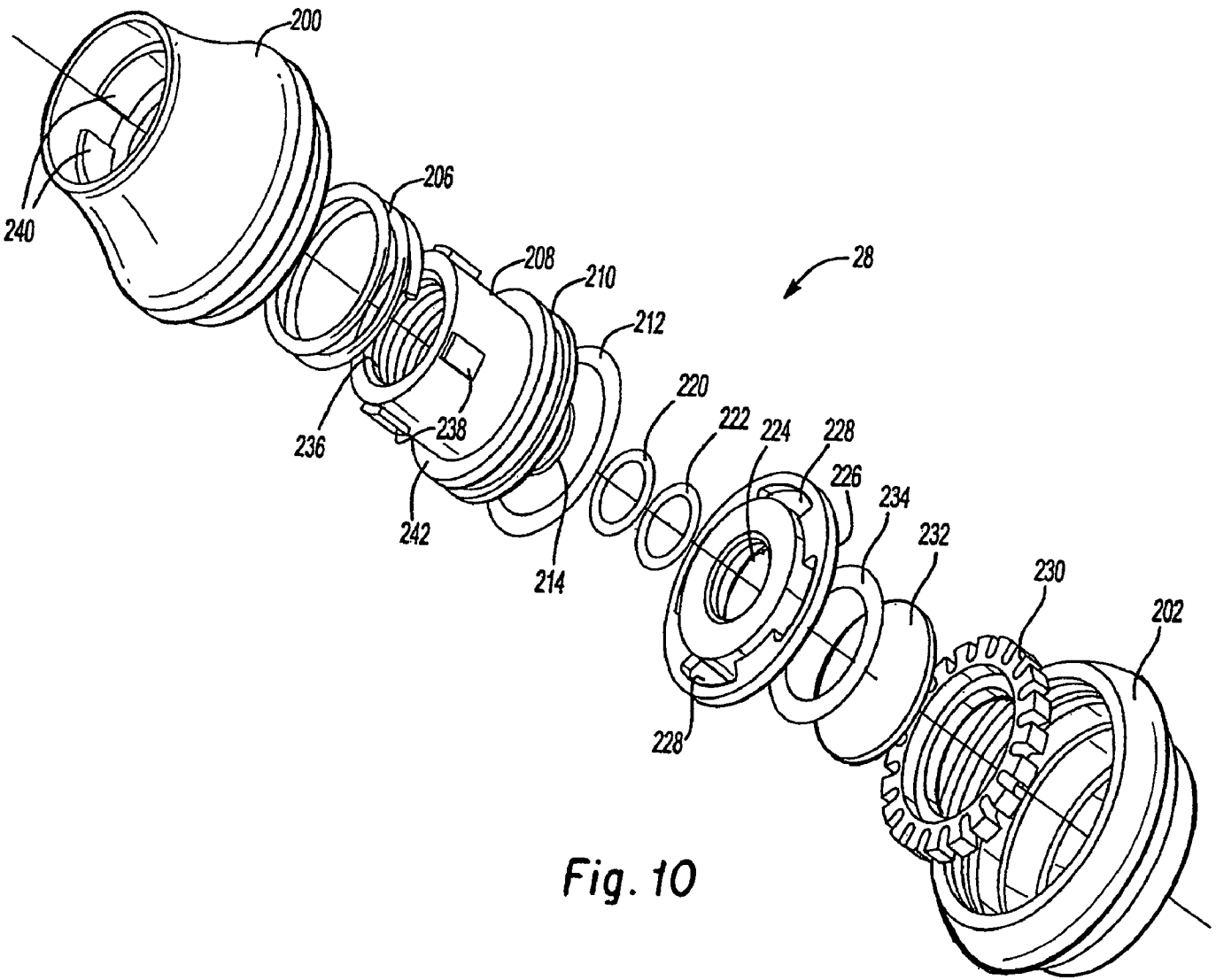
FIG. 10 is an exploded perspective view of the components of the pull-out head constructed in accordance with an alternative embodiment of the present invention.
Figure 11:
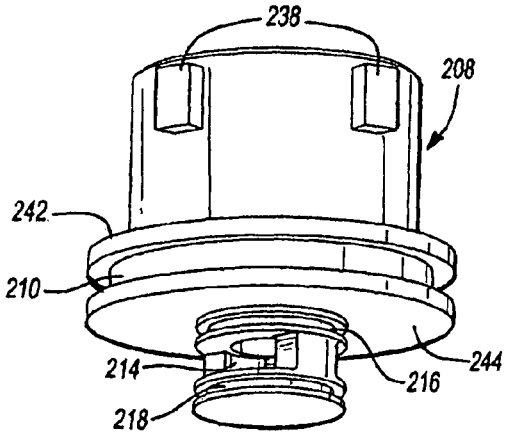
FIG. 11 is a perspective view of a flow toggle of FIG. 10.
Figure 12:
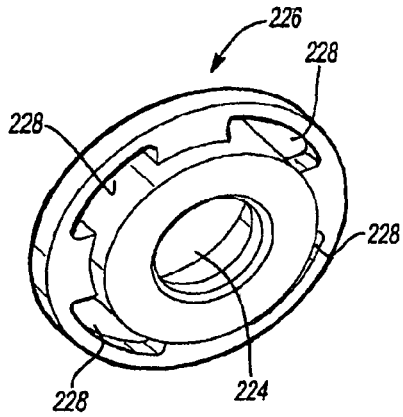
FIG. 12 is a perspective view of a diverter of FIG. 10.

With reference to FIGS. 10, 11, and 12, the pull-out head 28 includes an upper housing piece 200 that is connected to a lower housing piece 202 and hereinafter collectively referred to as a housing 204. A flow toggle 208 is contained within the housing 204 and includes a threaded portion 236 that may connect to the hose 66, which passes through the upper housing 200. A spring 206, is contained between the flow toggle 208 and the upper housing 200. The flow toggle 208 includes positioning lugs 238 and a flow toggle gasket seat 210 in which a flow toggle gasket 212 is seated. The flow toggle 208 further includes a flow duct 214, a flow duct top gasket seat 216, and a flow duct bottom gasket seat 218. A flow duct top gasket 220 is seated in the flow duct top gasket seat 216 and a flow duct bottom gasket 222 is seated in the flow duct bottom gasket seat 218.

The flow duct 214 of the flow toggle 208 is configured to reciprocate through a central aperture 224 defined by a diverter 226. The diverter 226 further defines an annular plurality of apertures 228 arranged around the central aperture 224. It should be appreciated that the central aperture 224 is not fluidly connected to the annular plurality of apertures 228 and vice-versa. In addition, the diverter 226 is connected to the lower housing piece 202 and secured in place when the lower housing piece 202 is connected with the upper housing 200.

Secured between the diverter 226 and the lower housing 202 is a spray ring 230. A flow screen 232 is contained within the spray ring 230. A flow screen gasket 234 is disposed between the diverter 226 and the flow screen 232. As such, the diverter 232 secures the flow screen gasket 234, the flow screen 232, and the spray ring 230 in the lower housing piece, when the upper housing piece 200 is secured to the lower housing piece 202.

The diverter 226 may be configured to contact the flow screen gasket 234 such that when water flows through the central aperture 224 of the diverter 226 the flow screen gasket 232 may prevent water from traveling through the spray ring 230. In turn, when water flows through the annular plurality of apertures 228 of the diverter 226 the flow screen gasket 234 may prevent water from traveling through the flow screen 232.

The upper housing 200 may be configured to contain the spring 206 between flanges 240 and an exterior face 242 of the flow toggle gasket seat 210. The retaining lugs 238 may be configured to maintain the position of the flow toggle 208 within the upper housing 200. The upper housing 200 may be additionally configured to connect to the lower housing 202 with conventional screw threads. One skilled in the art will readily appreciate that many methods exist to assemble the housing; some such examples include snap-fits, bonding, or mechanical fasteners.

Figure 13:
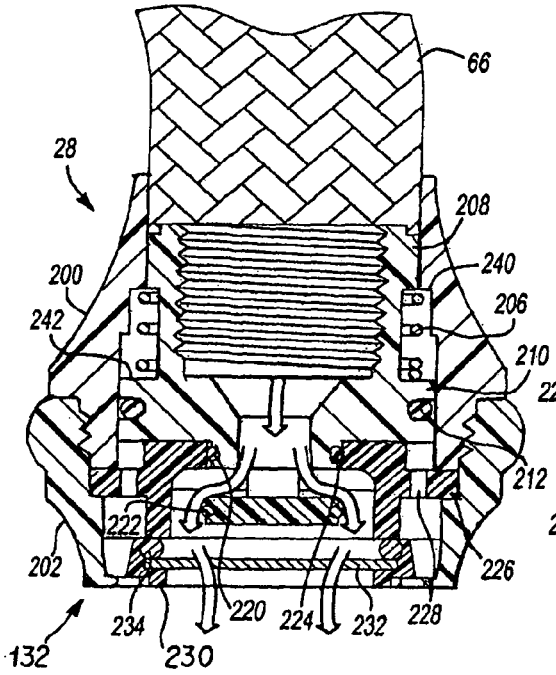
FIG. 13 is a cross-sectional view of the pull-out head of a FIG. 10 shown in the stream mode.
Figure 14:
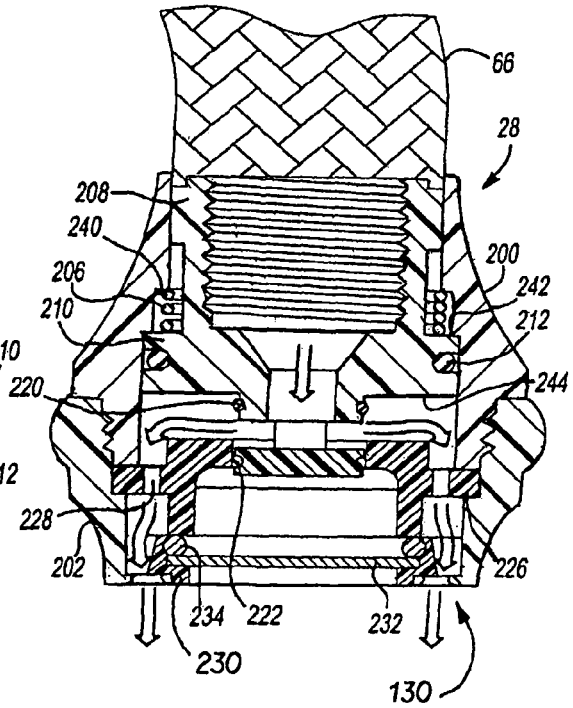
FIG. 14 is a cross-sectional view of the pull-out head of FIG. 10 shown in the spray mode.

With reference to FIGS. 13 and 14, the pull-out head 28 is presented in a stream-mode (FIG. 13) generally indicated by reference numeral 132 and in a spray-mode (FIG. 14) generally indicated by reference numeral 130. Movement of the flow toggle 208 results in the motion of the flow duct 214 in and out of central aperture 224 of the diverter 226. When the pull-out head 28 is in the stream mode 132, the flow toggle 208 reaches the bottom of its motion within the housing 204. In the stream mode 132, the flow duct top gasket 220 enters and seals the central aperture 224 of the diverter 226. When the pull-out head 28 is in the spray mode 130, the flow toggle 208 reaches the top of its motion. In the spray mode 130, the flow duct bottom gasket 222 seals within the central aperture 224 thereby disposing the flow duct 214 above the entrance to the central aperture 224.

In the stream mode 132, the flow duct top gasket 220 has entered and sealed the central aperture 224. As such, the flow duct 214 ejects water below the now sealed central aperture 224. Because the flow duct top gasket 220 has sealed the central aperture 224 above the flow duct 214, water ejected from the flow duct 214 can only exit through the flow screen 232 of the pull-out head 28.

In the spray mode 130, the flow duct bottom gasket 222 has sealed the central aperture 224. Because the central aperture 224 has been sealed, water flowing from the flow duct 214 must flow through the annular plurality of apertures 228 of the diverter 226. Water flowing through the annular plurality of apertures 228 then flows through the spray ring 230.

One skilled in the art will readily appreciate that the flow screen 232 is a modified conventional aerator screen, which causes the water to flow from the pull-out head 28 in a generally uniform column. The spray ring 230, in contrast, causes the water to spray in generally a cone-shaped pattern where individual streams of water may be recognizable. One skilled in the art will further appreciate that the ultimate pattern produced can be varied with modification of flow screen 232 or the spray ring 230. As such, the flow path of the water is determined by movement of the flow toggle 208 through the diverter 226; notwithstanding that fact, the ultimate pattern of water produced can be varied, made the same, or even eliminated or sealed where no water would flow altogether.

Switching between the stream mode 132 and the spray mode 130 may be effectuated by attachment or detachment of the pull-out head 28 to the end of the neck 26 of the spout 14. With the pull-out head 28 attached to the spout 14, the pull-out head 28 remains in the stream mode 132 because the end of the neck 26 has pushed the flow toggle 208 down to the bottommost point of its travel. With the flow toggle 208 down to the bottommost point of its travel, the flow duct 214 discharges water below the central aperture 224 of the diverter 226 and water is delivered in the stream mode 132.

Figure 15:
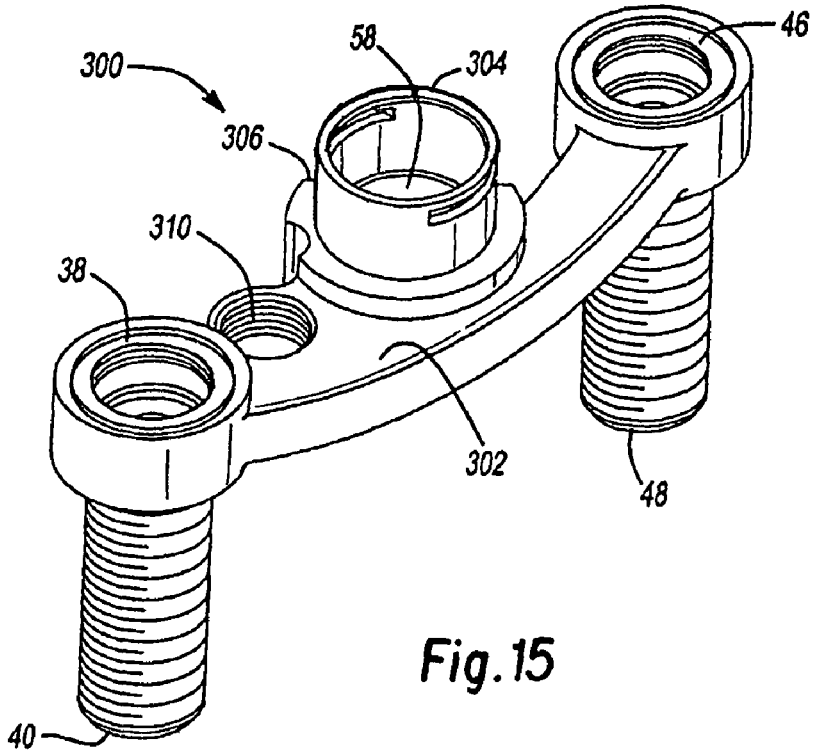
FIG. 15 is a perspective view of an underbody structure constructed in accordance with an alternative embodiment of the present invention.

In FIG. 13, the pull-out head 28 is shown in the stream mode 132 and, as such, the spring 206 is configured to be in a rest condition 138. In FIG. 15, the pull-out head is shown in the spray mode 130 and, as such, the spring 206 is configured to be in a compressed condition 140. It, therefore, follows that movement of the spring 206 from the rest position 138 (FIG. 13) to the compressed condition 140 (FIG. 14) generates a spring force in the spring 206; such that, the spring 206 imparts a predetermined force in an attempt to return to its rest position 138. The pull-out head 28, however, is configured to remain in the spray mode 130 while water or a like fluid flows through the pull-out head 28. Fluid flow through the pull-out head 28 in the spray mode 130, imparts a sufficient pressure on the bottom face 244 of the flow toggle 208 to maintain the pull-out head 28 in the spray mode 130. As such, when the fluid flow is discontinued, the spring force imparted by the spring 206 in the compressed condition 140 is sufficient to restore the pull-out head 28 to the stream mode 132.

Typically when the pull-out head 28 is attached to the neck 26, the pull-out head remains in the stream mode 132. When a user (not shown) wishes to detach the pull-out head 28 from the neck 26, the user may grasp the housing 204 and draw the pull-out head 28 away from the neck 26 and manipulate the head accordingly. As the user draws the pull-out head 28 away from the neck 26, the hose 66, the weight 68, and the neck 26 are configured to slightly restrain the pull-out head 28 so that the action of drawing the pull-out head 28 out of the neck 26 causes the pull-out head 28 to change from the stream mode 132 to the spray mode 130.

As noted above, if fluid is flowing through the pull-out head 28, the head 28 will remain in the spray mode 130. If no fluid is flowing through the head, the pull-out head 28 is configured to revert back to the stream mode 132 when the force generated by the action of drawing the pull-out head 28 out of the neck 26 no longer exists. Furthermore, the pull-out head 28 may be drawn from the neck 26 while fluid flows through the pull-out head 28, but the user may subsequently discontinue fluid flow through the pull-out head 28 by, among other things, shutting off the faucet 10. When fluid flow is discontinued, the pull-out head 28 reverts back to the stream mode 132.

Figure 16:
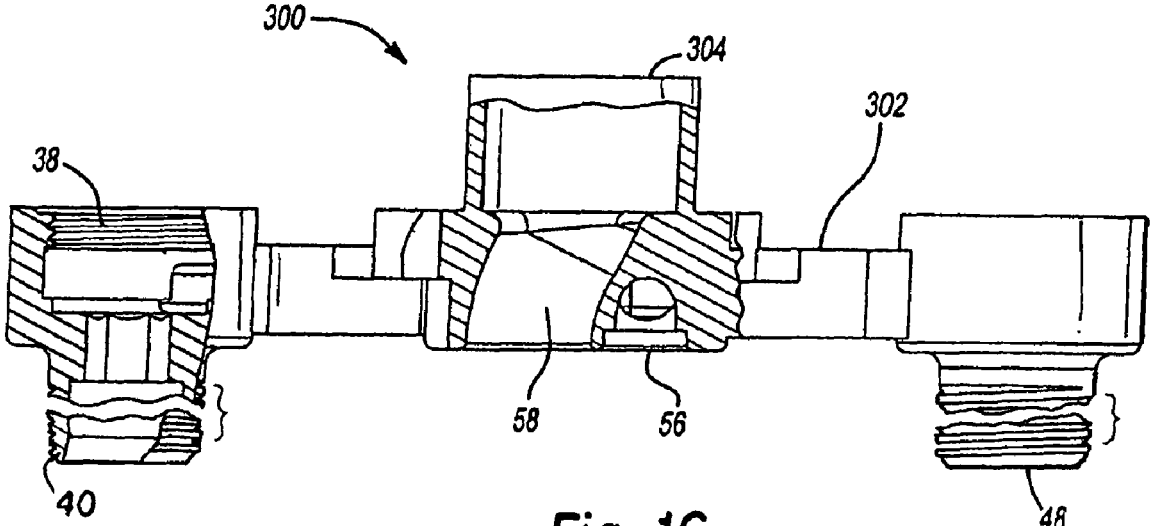
FIG. 16 is a detailed view of the underbody structure of FIG. 15 in partial cross-section.

FIGS. 15 and 16 depict the faucet 10 constructed in accordance with a preferred alternative embodiment of the present invention. As such, reference numerals that depict similar structures may be used to denote structures common to the various embodiments. It should be appreciated by one skilled in the art that structures disclosed in any one embodiment may be interchangeable with other embodiments. It should also be appreciated that the disclosed embodiments of the present invention are descriptive in nature and do not serve to limit the invention to the disclosed embodiments.

With reference to FIGS. 15 and 16, an underbody assembly is generally indicated by reference numeral 300. The underbody assembly 300 is a singular cast component that may include components found in the faucet base 12. To that end, the underbody assembly 300 is configured to include the hot water control mounting body 38 and the hot water supply line connection point 40. The underbody assembly 300 also includes the cold water control mounting body 46 and the hot water supply line connection point 48. In contrast to the cold water cupper pipe 50, the central body 20, and the hot water cupper pipe 42, the underbody assembly 300 is constructed as a singular unit. As such, a connection member 302 connects the cold water control mounting body 46 and the hot water control mounting body 38.

Figure 17:
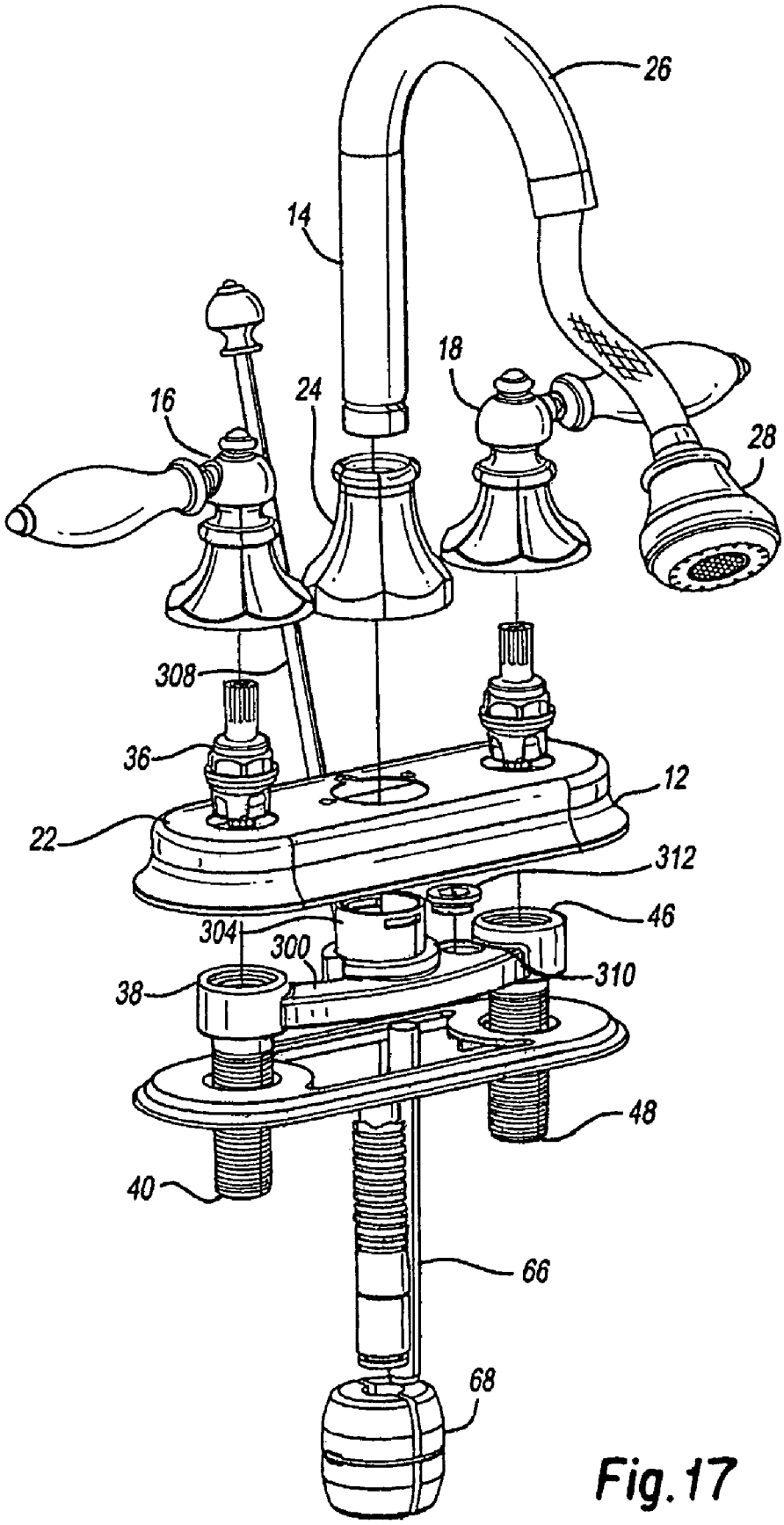
FIG. 17 is a perspective exploded view of an exemplary lavatory assembly constructed in accordance with an alternative embodiment of the present invention.

A mounting collar 304 connects to the connection member 302. The mounting collar is configured to connect to the spout 14 and is further configured to serve as a fluid connection between the connection member 302 and the spout 14. The mounting collar 304 additionally defines a pop-rod channel 306 through which a pop-rod 308 passes (FIG. 17). A vacuum breaker seat 310 is configured to accept a vacuum breaker 312 (FIG. 17). It should be appreciated by one skilled in the art that a vacuum breaker may be located at various points within the faucet 10. As shown, the vacuum breaker 312 is located in the underbody assembly 300, but may be located in either the hot or cold water control mounting bodies 38, 46 or other suitable locations.

Similar to the central body 20, the underbody assembly includes a hose pass-through 58, which is disposed in a central location on the underbody assembly 300. The hose pass-through 58 is slightly canted to accommodate the geometry of the underbody assembly 300 but still allow for the hose 66 to pass through the hose pass-through 58 unimpeded. The mixed fluid output 56 is configured to connect to the hose 66 (FIG. 1).

FIG. 17 depicts the faucet 10 presented in a lavatory configuration and constructed in accordance with a preferred alternative embodiment of the present invention. As such, reference numerals that depict similar structures may be used to denote structures common to the various embodiments. It should be appreciated by one skilled in the art that structures disclosed in any one embodiment may be interchangeable with other embodiments. It should also be appreciated that the disclosed embodiments of the present invention are descriptive in nature and do not serve to limit the invention to the disclosed embodiments.

While there are many similar structures in a lavatory installation when compared to a kitchen installation, one frequent configuration difference is distance between the hot water supply line connection point 40 and the cold water supply line connection point 48. In a typical lavatory installation this distance is four inches (about 100 millimeters), but in a kitchen installation this distance is about eight inches (about 203 millimeters). Notwithstanding typical installations, some faucet configurations only have a single water control which would not necessitate the above spacing. To that end, many configurations are possible and furthermore scaling of the components from a kitchen to a lavatory installation is also possible to make the faucet 10, regardless of the installation, more appealing to the consumer.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A faucet comprising:

a pull-out head coupled to a faucet base by a hose, said pull-out head switchable between a first water discharge pattern and a second water discharge pattern, wherein said pull-out head switches from said first water discharge pattern to said second water discharge pattern in response to disengagement with said faucet base and wherein said first water discharge pattern includes a stream mode and said second water discharge pattern includes a spray mode.

2. The faucet of claim 1, further comprises a hot water control and a cold water control are fluidly connected to one of a central body and an underbody assembly.

3. The faucet of claim 2, wherein said hot water control includes an off position, an on position, and a plurality of positions between said off position and said on position.

4. The faucet of claim 2, wherein said cold water control includes an off position, an on position, and a plurality of positions between said off position and said on position.

5. The faucet of claim 2, wherein a hot water passage connects said hot water control to said central body, and wherein a cold water passage fluidly connects said cold water control to said central body.

6. A sink faucet comprising:

a faucet base adapted to be mounted on a sink deck, said faucet base including an underbody assembly having at least one supply port fluidly coupled to a mixing body through a supply valve and a spout;

a hose slidably positionable within said spout, said hose having a first end fluidly coupled to said mixing body; and a pull-out head fluidly coupled to a second end of said hose, said pull-out head positionable in a stowed position to engage said spout such that a mode valve in said pull-out head operates in a stream mode through a stream port and switches to operating in a spray mode through a spray port in response to movement to an extended position.

7. The sink faucet of claim 6 wherein said faucet base further comprises a first supply port fluidly coupled to said mixing body through a first supply valve and a second supply port fluidly coupled to said mixing body through a second supply valve.

8. The sink faucet of claim 6 wherein said mode valve comprises a flow toggle coupled to said hose and a diverter slidably positionable relative to said flow toggle for switching said mode valve between said stream mode and said spray mode.

9. The sink faucet of claim 8 wherein said flow toggle has a radial flow duct formed therein and said diverter has a central aperture formed therein, said diverter being slidably positionable relative to said flow toggle between a first position wherein said radial flow duct is in fluid communication with said stream port and a second position wherein said radial flow duct is in fluid communication with said spray port.

10. The sink faucet of claim 9 further comprising a spring operably disposed in said pull-out head to impart a biasing force on said diverter toward said first position.

11. The sink faucet of claim 10 wherein said diverter has a sealing face formed thereon, said sealing face being in fluid communication with said radial flow duct when said mode valve is in said spray mode such that a fluid pressure exerted on said sealing face counteracts said biasing force to maintain said mode valve in said spray mode.

12. The sink faucet of claim 6 wherein said pull-out head further comprises:

a first flow path from said hose through said mode valve to an aerator centrally disposed in said pull-out head to provide said stream mode; and a second flow path from said hose through said mode valve to a set of apertures disposed around said aerator to provide said spray mode.

13. The sink faucet of claim 12 wherein said mode valve comprises a flow toggle coupled to said hose and a diverter slidable with respect to said flow toggle, said diverter positionable in a first position to select said first flow path and a second position to select said second flow path.

14. The sink faucet of claim 13 wherein said flow toggle has a radial flow duct and said diverter has a central aperture formed therein, wherein a portion of said flow toggle is positioned below said central aperture such that said first flow path is defined from said radial flow duct to said stream port when said diverter is in said first position, and wherein said radial flow duct is positioned above said central aperture such that said second flow path is defined from said radial flow duct to said spray port when said diverter is in said second position.

15. The sink faucet of claim 14 further comprising a spring operably disposed in said pull-out head to impart a biasing force on said diverter toward said first position.

16. The sink faucet of claim 15 wherein said diverter has a sealing face formed there on said sealing face being in fluid communication with said radial flow duct when said diverter is in said second position such that a fluid pressure exerted on said sealing face counteracts said biasing force to maintain said mode valve in said spray mode.

* * * * *